United States Patent [19]

Weideman

[11] 4,413,731

[45] Nov. 8, 1983

[54] PACKAGING ARRANGEMENT FOR CUTTING TOOLS SUCH AS DRILLS

[75] Inventor: Allen T. Weideman, North Hollywood, Calif.

[73] Assignee: Tulon, Inc., Gardena, Calif.

[21] Appl. No.: 396,109

[22] Filed: Jul. 7, 1982

[51] Int. Cl.[3] ..... B65D 85/28

[52] U.S. Cl. ..... 206/379; 206/583; 206/443

[58] Field of Search ..... 206/583, 379, 443, 382, 206/485, 587, 593, 561, 562, 564

[56] References Cited

U.S. PATENT DOCUMENTS

| | | | |
|---|---|---|---|
| 1,881,464 | 10/1932 | Gagen | 206/583 |
| 2,844,244 | 7/1958 | Hanson | 206/379 |
| 3,154,192 | 10/1964 | Cowley | 206/379 |
| 3,499,525 | 3/1970 | Kanter | 206/379 |

FOREIGN PATENT DOCUMENTS

| | | | |
|---|---|---|---|
| 756174 | 9/1970 | Belgium | 206/583 |
| 557208 | 2/1957 | Italy | 206/379 |

*Primary Examiner*—Joseph Man-Fu Moy

*Attorney, Agent, or Firm*—Gausewitz, Carr, Rothenberg & Edwards

[57] ABSTRACT

This invention provides a packaging arrangement for cutting tools such as drill bits in which a collar is placed on the shank of the tool, and the shank of the tool is fitted into opposed slots in parallel walls in a receptacle with the collar received between and frictionally gripped by the walls so as to suspend the tool in the receptacle spaced from the receptacle walls. A lid member fits over the receptacle and has an element extending over the tool to prevent the tool from being dislodged from the slots.

12 Claims, 5 Drawing Figures

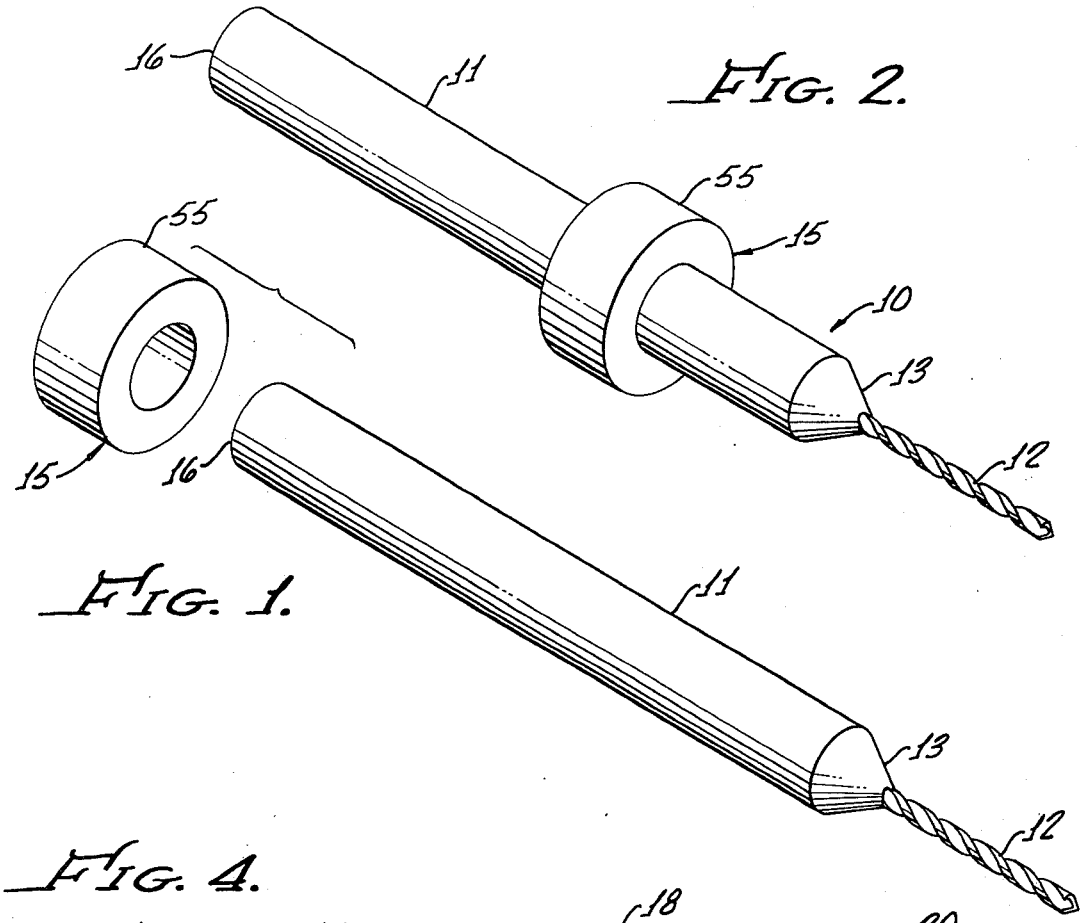
FIG. 2.
FIG. 1.
FIG. 4.
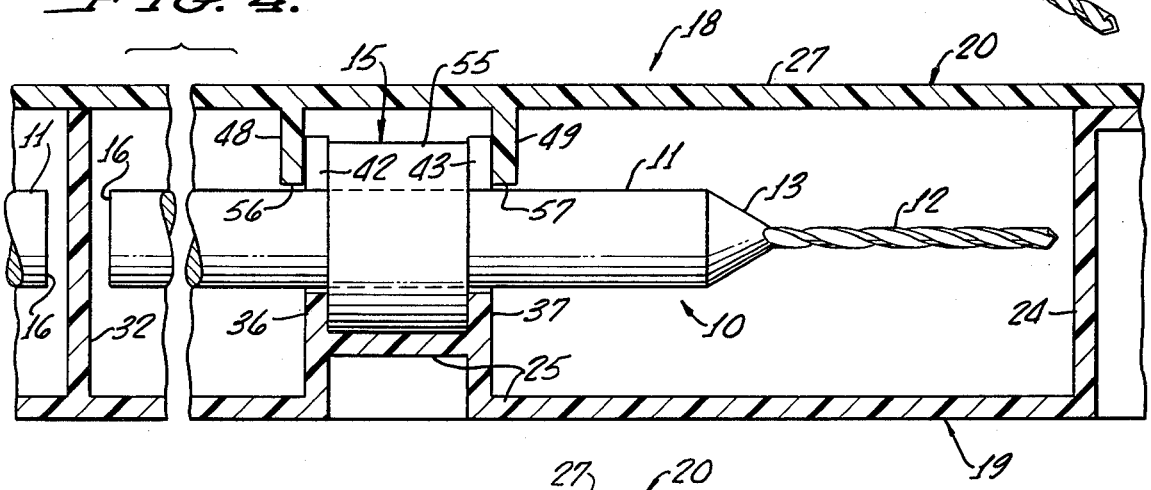
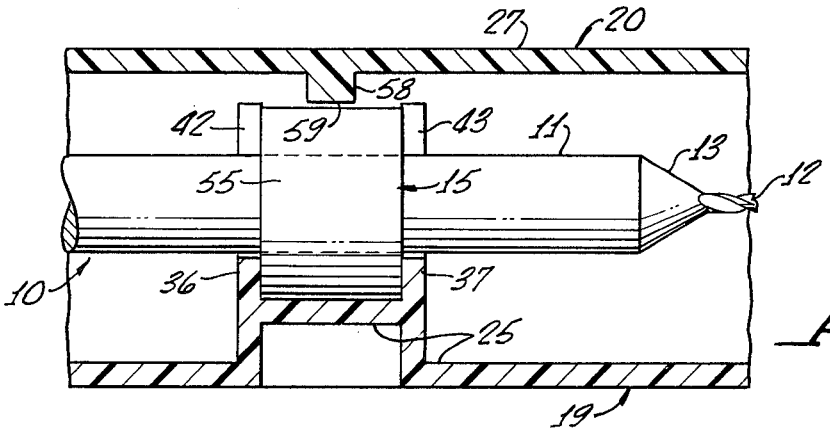
FIG. 5.

4
4
18
19
20
21
22
23
24
25
27
28
29
30
32
34
35
36
37
38
39
40
41
42
43
44
45
46
47
48
49
51
52
10
11
12
13
15

PACKAGING ARRANGEMENT FOR CUTTING TOOLS SUCH AS DRILLS

BACKGROUND OF THE INVENTION

The printed circuit board industry makes extensive use of carbide drills for drilling precisely dimensioned holes through the circuit boards. The carbide drills are very hard and, at the same time, quite brittle. These drills normally have cylindrical shanks of uniform diameter, irrespective of the drill size, for reception in the collet of the drilling machine. The fluted cutting end of the drill projects from one end of the shank, and comes in various sizes, some being as small as 0.008 inch diameter. These small drill ends are very easily broken, which has led to a major problem in the shipment and handling of these drills. Conventionally, the package for the drills is a box having a base with a number of holes in it, into which the shanks of the drills are inserted endways, so that the cutting ends project above the base. The sides of the boxes fit around the projecting portions of the drills. However, this offers very poor protection, allowing many of the drills in the package to become broken, even during careful handling. Carbide drills are expensive, so the drill breakage has added significantly to costs, as well as inventory problems in maintaining adequate supplies of unbroken drills.

SUMMARY OF THE INVENTION

The present invention provides a vastly improved packaging arrangement for brittle, breakable drills, or other cutting tools, overcoming the problems discussed above. In addition, the package is relatively inexpensive, readily manufactured and easily used.

In accordance with the invention, a plastic collar is positioned on the shank of a drill at the factory prior to the time that the drill enters the container for it. This collar corresponds to the depth setting ring normally placed on the drill by the user to act as a stop in assuring that the collet of the drilling machine receives the same length of shank for all of the drills it grips. This provides uniform drilling depths and facilitates the use of automatic tool changers. See U.S. Pat. No. 3,973,863.

A box is prepared having a receptacle portion with a bottom wall and opposed flanges projecting from it. These flanges are spaced apart a distance that will enable them to receive the collars on the shanks between them. Their spacing is substantially equal to the axial lengths of the collars, but slightly less so that the collars are frictionally gripped by the flanges. Opposed slots in the flanges, slightly wider than the shank diameters, receive the shanks of the drills. Thus, each drill is suspended by its plastic collar and positioned with its breakable end spaced above the bottom wall and protected within the receptacle. A lid fits on the receptacle and has a flange arrangement to assure that the shanks cannot escape from the slots. This may be in the form of parallel flanges depending from the lid, fitting over the shanks on opposite sides of the flanges that project from the bottom wall. Alternatively, a single flange may depend from the lid and fit over the collar.

BRIEF DESCRIPTION OF THE DRAWINGS

FIG. 1 is a perspective view of a drill and a collar used in the packaging of the drill;

FIG. 2 is a perspective view of the drill with the collar installed on it shank;

FIG. 4 is an enlarged sectional view taken along line 4—4 of FIG. 3; and

FIG. 5 is a view similar to FIG. 4 of an alternate embodiment.

DETAILED DESCRIPTION OF THE INVENTION

Figure 3:
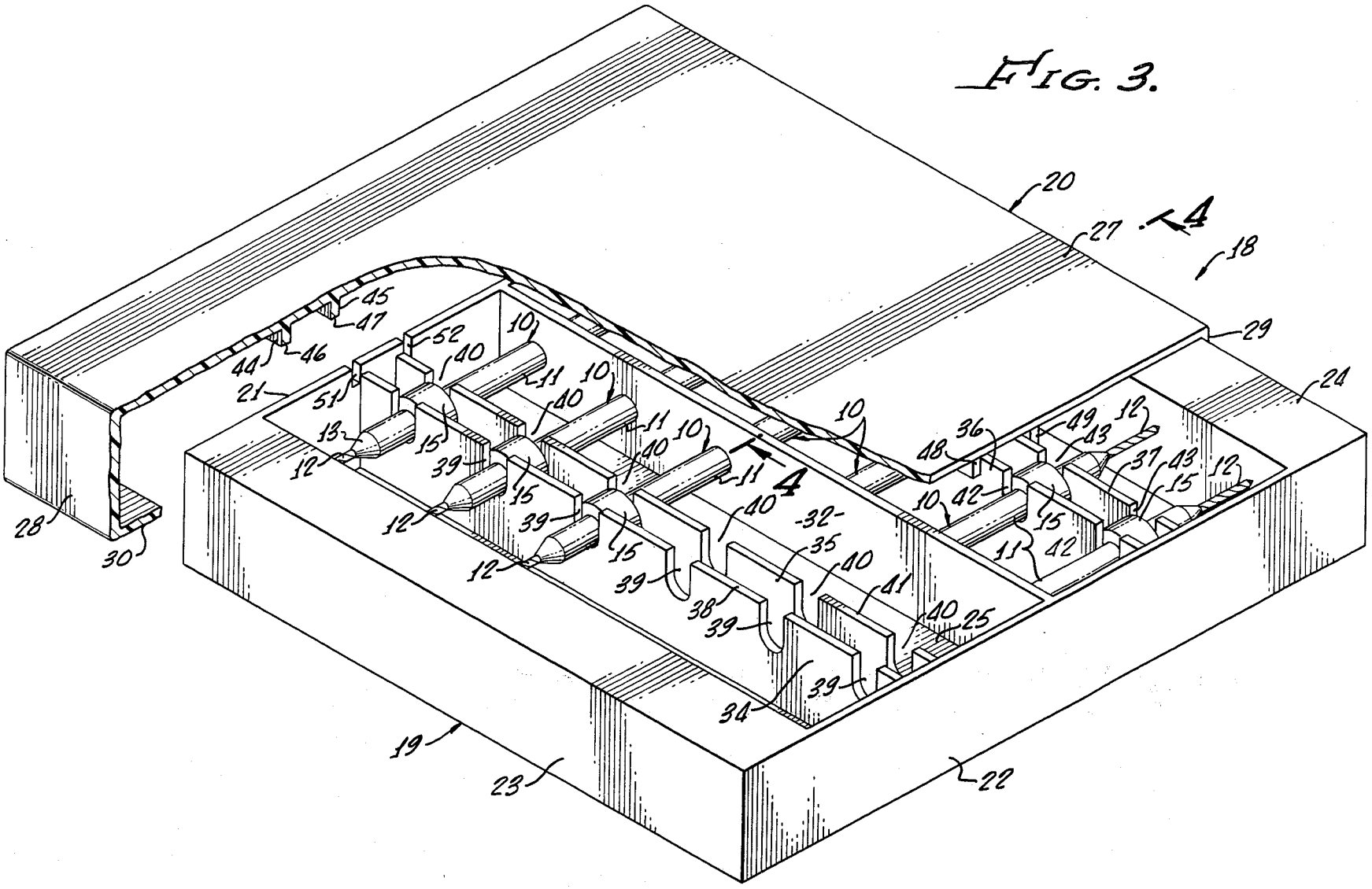
FIG. 3 is a perspective view, partially broken away, of the package for the drills.

The drill bit 10 shown in FIG. 1 is of carbide, hence being hard and brittle. It includes a cylindrical shank 11 at one end, which is adapted to enter the collet of a drilling machine. The opposite end 12 of the drill bit 10 is fluted and terminates at a cutting tip. In some instances, the end 12 of the drill may be very small, such as 0.008 inch diameter. Hence, the end 12 is fragile and susceptible to breakage. A frustoconical portion 13 connects the cylindrical shank 11 with the end 12.

A plastic collar 15 is press-fitted onto the cylindrical shank 11 and positioned at a predetermined axial distance from the outer end 16 of that portion of the shank. Normally, this operation is performed by the user of the drill, with the collar 15 then forming a stop which is engaged by the collet when the drill is used, so that a predetermined length of the shank 11 is inserted into the collet. In this instance, however, the collar 15 is positioned on the shank 11 at the factory and used first in the packaging of the drill 10.

A box 18 of plastic material receives a number of the drills 10, accommodating ten in the embodiment illustrated. The box 18 includes a shallow receptacle portion 19 and a lid 20. The receptacle portion 19 includes end walls 21 and 22, as well as double sidewalls 23 and 24. There is also a bottom wall 25, but the top of the receptacle 19 is open.

The lid 20 has a top wall 27 and sidewalls 28 and 29 that fit alongside the outer surfaces of the sidewalls 23 and 24 of the receptacle portion 19. A narrow flange 30 projects from the bottom edge of the sidewall 28 and a similar flange on the sidewall 31, these flanges fitting beneath the bottom wall 25 of the receptacle 19. As a result, the lid is retained on the receptacle, but can slide relative to it.

Integral with, and projecting upwardly from, the bottom wall 25 is a center wall 32, which is the full height of, and extends between, the end walls 21 and 22. This divides the receptacle 19 into two portions of equal size. The spacing between the center wall 32 and the sidewalls 23 and 24 is greater than the length of the drill 10.

A pair of opposed, upstanding, parallel walls or flanges 34 and 35 is located in one of the sections of the receptacle 19, and a similar pair 36 and 37 in the other. The flanges 34, 35, 36 and 37 are shorter than the walls of the receptacle and extend between the end walls 21 and 22 parallel to the sidewalls 23 and 24. These flanges are integral with, and project upwardly from, the bottom wall 25.

Extending downwardly from the top edge 38 of the flange 34 are slots 39, which have parallel side edges perpendicular to the bottom wall 25, and which have inner ends spaced above the bottom wall. In the embodiment illustrated, there are five of the slots 39 in the flange 34, which are slightly wider than the diameter of the shank 11. Identical slots 40 extend downwardly from the upper edge 41 of the flange 35, the slots 40 being opposite from the slots 39. The same construction is followed in the flanges 36 and 37, which are provided with opposed slots 42 and 43, respectively.

Depending from the top wall 27 of the lid 20 are two flanges 44 and 45 which straddle the flanges 34 and 35, fitting closely alongside the outer surfaces of the latter flanges. The bottom edges 46 and 47 of the flanges 44 and 45 are spaced above the inner ends of the slots 39 and 40. Similar flanges 48 and 49 on the wall 27 of the lid 20 receive the other flanges 36 and 37 of the receptacle 19. The end wall 21 of the receptacle is provided with slots 51 and 52 that receive the flanges 44 and 45, with similar slots for the flanges 48 and 49, allowing the lid 20 to be slid relative to the receptacle 19. The opposite end wall 22 of the receptacle, however, is not slotted, so that the ends of the flanges 44, 45, 48 and 49 act as stops, limiting the movement of the lid 18 on the receptacle 19.

The drills 10, with the collars 15 received on the shanks 11, are retained by the flanges 34, 35, 36 and 37, as illustrated in FIGS. 3 and 4. The shanks 11 of the drill bits 10 in one instance fit within the opposed slots 39 and 40 with the collars 15 positioned between the flanges 34 and 35. In the other portion of the receptacle 19 the drill shanks 11 enter the slots 42 and 43 with the collars 15 between the flanges 36 and 37.

The opposed flanges are spaced apart a distance approximating the lengths of the collars 15, but are slightly closer together so that the flanges spring apart a minor amount as the collars are forced into the space between them. Thus, the flanges frictionally grip the ends of the collars 15. As shown in FIG. 4, the collars 15 are pushed downwardly to the location where their circumferential surfaces 55 engage the elevated portions of the bottom wall 25 between the flanges. In that position, the shanks 11 are spaced from the inner ends of the slots 39, 40, 42 and 43. Therefore, the drill bits 10 are suspended within the receptacle 19 by the collars 15, spaced from each other and with no rigid retention by the components of the box 18. The drills are spaced from the walls of the box so as to be protected fully.

The depending flanges 45, 46, 48 and 49 of the lid 20 fit over the drills 10, as seen in FIG. 4, preventing the drills from being dislodged from the support flanges 34, 35, 36 and 37, even under the most extreme shock loads. Thus, the bottom edges 56 and 57 of the flanges 48 and 49 are positioned just over the drill shanks 11 to assure that the drills remain in place.

As a result of this arrangement, the drills 10 are securely held and protected for shipment and storage with the risk of breakage being minimized. The fragile fluted ends 12 of the drills are suspended by the collars 15 so that they are spaced between the bottom wall 25 of the receptacle and the top wall 27 of the lid and nothing will contact them to cause breakage. The frictional gripping of the collars helps shock loads to be absorbed without damaging the drills. The drills will not shift around within the box, even under severe vibrational and shock loads, so that they remain safely secured. The box inherently is strong with its various flanges, so that it resists forces tending to crush, bend or break it. A further advantage to the consumer is the installation of the depth setting collar at the factory so that the drill is ready for use as received.

The alternate embodiment of FIG. 5 is the same as the previously described embodiment, except for the manner in which the drills are prevented from escaping from the slots in the flanges of the receptacle 19. Instead of a pair of flanges on the lid straddling the opposed flanges of the receptacle, there is only a single flange 58 depending from the lid wall 27. Thus, as seen in FIG. 5, the flange 58 of the lid wall 27 extends downwardly at a location between the two flanges 36 and 37. The flange 58 has a lower edge 59 adjacent the circumferential surfaces 55 of the collars 15. This precludes upward movement of the collars 15 and, hence, of the drills 10.

The foregoing detailed description is to be clearly understood as given by way of illustration and example only, the spirit and scope of this invention being limited solely by the appended claims.

What is claimed is:

1. In combination with a cutting tool having a shank for insertion into the collet of a machine and a portion having a cutting means thereon projecting from one end of said shank, a packaging arrangement for said cutting tool comprising a plastic collar received on said shank and frictionally retained thereon between the ends thereof;

a first member defining opposed parallel walls having free outer edges and a bottom wall, each of said parallel walls having a slot therein extending inwardly from said free outer edge thereof, said slots being aligned and being wider than the diameter of said shank, said shank extending through said slots, and said collar being positioned intermediate said walls and gripped thereby so as to suspend tool above said bottom wall by said collar, and a second member having means for retaining said shank so received in said slots.

2. A device as recited in claim 1 in which said first and second members collectively define a box in which said cutting tool is received, said cutting tool being spaced from the walls of said box.

3. A device as recited in claim 2 in which said first member defines a receptacle portion of said box, and said second member defines a lid portion of said box, said receptacle portion having said bottom wall, said opposed parallel walls projecting upwardly from said bottom wall.

4. A device as recited in claim 1 in which said means for retaining said shank so received in said slots comprises a duality of elements carried by said second member, said opposed parallel walls being adjacent and received between said elements, and said elements having edges adjacent said shank.

5. A device as recited in claim 1 in which said means for retaining said shank so received in said slots comprises an element carried by said second member, said element being intermediate said walls and having an edge adjacent said collar.

6. In combination with a plurality of drill bits, each of which has a shank for insertion into the collet of a drilling machine and an end portion having cutting means thereon projecting from said shank, a packaging arrangement for said drill bits comprising a plastic collar receiving each of said shanks and frictionally retained thereon between the ends thereof, a receptacle member having a bottom wall and opposed parallel flanges projecting upwardly from said bottom wall, said flanges having free outer edges, each of said flange shaving a plurality of slots therein extending inwardly from said free outer edge thereof, said slots being wider than the diameter of said shank and aligned so as to define opposed pair of slots, and said shanks of said drill bits being received in said opposed pairs of slots with said collars being received between said flanges with the ends of said collars being frictionally gripped by said flanges so that said drill bits are spaced from said bottom wall, and a lid means having a wall extending above and opposite from said bottom wall, said wall of said lid means having flange means thereon for retaining said drill bits in said opposed pairs of slots.

7. A device as recited in claim 6 in which said flange means comprises a pair of opposed parallel flanges depending from said wall of said lid means and adjacent the outer surfaces of said opposed flanges of said receptacle, said opposed flanges of said lid means having bottom edges adjacent the upper surfaces of said shanks.

8. The method of packaging a cutting tool having a cylindrical shank and an end portion having cutting means thereon projecting from one end of said shank comprising the steps of positioning said shank within a plastic collar which is frictionally retained on said shank intermediate the ends thereof, providing a container means, providing in said container means opposed parallel members spaced apart a distance slightly less than the axial length of said collar, providing a slot in each of said members extending inwardly from one edge thereof with said slots being positioned opposite each other and made to a width slightly greater than the diameter of said shank, and then positioning said shank in said slots with said collar between said members so that said members frictionally grip the ends of said collar and suspend said cutting tool by said collar within said container means and spaced from the walls thereof.

9. The method as recited in claim 8 in which in providing said container means a receptacle is formed, said receptacle having a bottom wall, said members being made as flanges projecting above said bottom wall, said slots being extended downwardly from the edges of said flanges opposite from said bottom wall.

10. The method as recited in claim 8 including the step of positioning an element adjacent said cutting tool for preventing said shank from being dislodged from said slots.

11. The method as recited in claim 10 in which said element is formed with two portions which are positioned on opposite sides of said members adjacent said shank.

12. The method as recited in claim 11 in which said element is positioned between said members adjacent the circumferential surface of said collar.

* * * * *

UNITED STATES PATENT AND TRADEMARK OFFICE

CERTIFICATE OF CORRECTION

PATENT NO. : 4,413,731

DATED : Nov. 8, 1983

INVENTOR(S) : Allen T. Weideman

It is certified that error appears in the above-identified patent and that said Letters Patent are hereby corrected as shown below:

Column 1, line 68, "it" should read ---its---.

In claim 6 (column 4, line 67), "flange shaving" should read ---flanges having---.

In claim 6 (column 5, line 2), "pair" should read ---pairs---.

Signed and Sealed this

*Eighth* Day of *May 1984*

[SEAL]

*Attest:*

GERALD J. MOSSINGHOFF

*Attesting Officer*

*Commissioner of Patents and Trademarks*